US011503686B2

(12) United States Patent
Lu et al.

(10) Patent No.: US 11,503,686 B2
(45) **Date of Patent: *Nov. 15, 2022**

(54) LAMP TUBE WITH ANTI-SHOCK PROTECTION AND COMPATIBLE WITH MULTIPLE POWER SUPPLY MODES

(71) Applicant: Xiamen PVTECH Co., Ltd., Fujian (CN)

(72) Inventors: Fuxing Lu, Fujian (CN); Rongtu Liu, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/477,492

(22) Filed: Sep. 16, 2021

(65) Prior Publication Data

US 2022/0272807 A1 Aug. 25, 2022

(30) Foreign Application Priority Data

Feb. 21, 2021 (CN) ..... 202110194636.4
May 31, 2021 (CN) ..... 202110597510.1

(51) Int. Cl.
*H05B 45/345* (2020.01)
*H05B 45/50* (2022.01)
*H05B 45/3725* (2020.01)

(52) U.S. Cl.
CPC ..... *H05B 45/345* (2020.01); *H05B 45/3725* (2020.01); *H05B 45/50* (2020.01)

(58) Field of Classification Search
CPC ... H05B 45/50; H05B 45/345; H05B 45/3725
See application file for complete search history.

(56) References Cited

U.S. PATENT DOCUMENTS 11,265,987 B1 * 3/2022 Lu ..... H05B 45/3575
2019/0264879 A1 * 8/2019 Xiong ..... H05B 45/375
2020/0256521 A1 * 8/2020 Xiong ..... F21V 29/70
2020/0271279 A1 * 8/2020 Xiong ..... H05B 45/37

* cited by examiner

*Primary Examiner* — Abdullah A Riyami
*Assistant Examiner* — Syed M Kaiser
(74) *Attorney, Agent, or Firm* — Winston Hsu

(57) ABSTRACT

A lamp tube with anti-shock protection and compatible with a plurality of current stable power supply modes is provided. The lamp tube includes a plurality of lighting loads and a control circuit. The control circuit includes an electric shock protection circuit, a filtering and constant current driving circuit, an electronic rectifier circuit and a fast-start inductive rectifier detection and driving circuit.

11 Claims, 4 Drawing Sheets

LAMP TUBE WITH ANTI-SHOCK PROTECTION AND COMPATIBLE WITH MULTIPLE POWER SUPPLY MODES

CROSS REFERENCE TO RELATED APPLICATION

This applicant claims the priority benefit of China Patent Application No. 202110597510.1, filed May 31, 2021, and of China Patent Application No. 202110194636.4, filed Feb. 21, 2021, each of which is included herein by reference in their entireties.

BACKGROUND OF THE INVENTION

1. Field of the Invention

The invention relates to a lamp tube and, more particularly, to a lamp tube with anti-shock protection and compatible with a plurality of current stable power supply modes (such as electronic rectifiers, fast inductive rectifiers and mains power supplies).

2. Description of the Prior Art

In recent years, with the trend of energy saving and emission reduction, LED (light-emitting diode) light sources are wildly used in different markets. LED lighting sources provide an innovative lighting device and reduce energy consumption effectively. They will be widely used in power-deficient areas and global markets in future.

Conventional fluorescent lighting devices on the market mainly include lamp holders, fluorescent tubes and electronic ballasts. To replace the fluorescent tubes with LED tubes to save power, electronic ballast LED tubes with same specifications are needed, and the whole lamp tube holder also needs to be replaced. However, it is time-consuming and costly.

SUMMARY OF THE INVENTION

A lamp tube is provided. A lamp tube with anti-shock protection and compatible with a plurality of current stable power supply modes, comprises: two conductive pin sets are configured at two end of the lamp tube to be electrically connected to a power supply, respectively, the conductive pin set includes two pins, the lamp tube includes a plurality of lighting loads and a control circuit, the control circuit is electrically connected to the lighting loads and the two conductive pin sets, respectively, the control circuit includes an electric shock protection circuit, a filtering and constant current driving circuit, an electronic rectifier circuit and a fast-start inductive rectifier detection and driving circuit, the fast-start inductive rectifier detection and driving circuit further includes an input voltage rectification and voltage clamp module, a fast-start inductive rectifier pre-driver module, a fast-start inductive rectifier identification module, a fast-start type inductive rectifier output drive module, and an output load selection module, the input voltage rectifier and voltage clamp module includes a first resistor, a transient voltage suppressor diode, and a positive temperature coefficient thermistor, and an electrolytic capacitor, a positive temperature coefficient thermistor, the positive temperature coefficient thermistor is electrically connected in series with the transient voltage suppressor diode, the first resistor is connected in parallel with two ends of the transient voltage suppressor diode as a dummy load, the electrolytic capacitor is connected in parallel with two ends of the transient voltage suppressor diode and the first resistor to have DC filtering, the input voltage rectification and voltage clamp module rectifies an input AC voltage to convert the AC voltage to a pulsating DC voltage and clamps the rectified pulsating DC voltage via the first resistor, the transient voltage suppression diode, and the positive temperature coefficient thermistor as a power supply for a signal transfer assembly.

In summary, according to embodiments, besides the electric shock protection circuit, the filtering and constant current drive circuit and the type A electronic rectifier circuit, the control circuit further includes the fast-start inductive rectifier detection and drive circuit. Then, the electronic rectifier is compatible with fast-start inductive rectifier and mains-powered lamp tubes while the leakage protection is reliable. Additionally, the input to the lamp tube can be from either end of the lamp tube, and the light adjusting requirement in the rectifier mode can be meet.

These and other objectives of the present invention will no doubt become obvious to those of ordinary skill in the art after reading the following detailed description of the preferred embodiment that is illustrated in the various figures and drawings.

DETAILED DESCRIPTION

These and other features, aspects and advantages of the present invention will become better understood with regard to the following description, appended claims, and accompanying drawings.

Via a type A electronic rectifier circuit and a fast-start inductive rectifier detection and drive circuit in an internal control circuit of a lamp tube, the voltage of the power supply input, the voltage of the electronic rectifier circuit input or the voltage of the fast-start inductive rectifier detection and drive circuit input can be identified. The control circuit includes an electric shock protection circuit. The leakage protection is more reliable. The electronic rectifier is compatible with the fast-start inductive rectifier and the power supply. Additionally, the input to the lamp tube can be from either end of the lamp tube, and the light adjusting requirement in the rectifier mode can be meet.

Figure 1A:
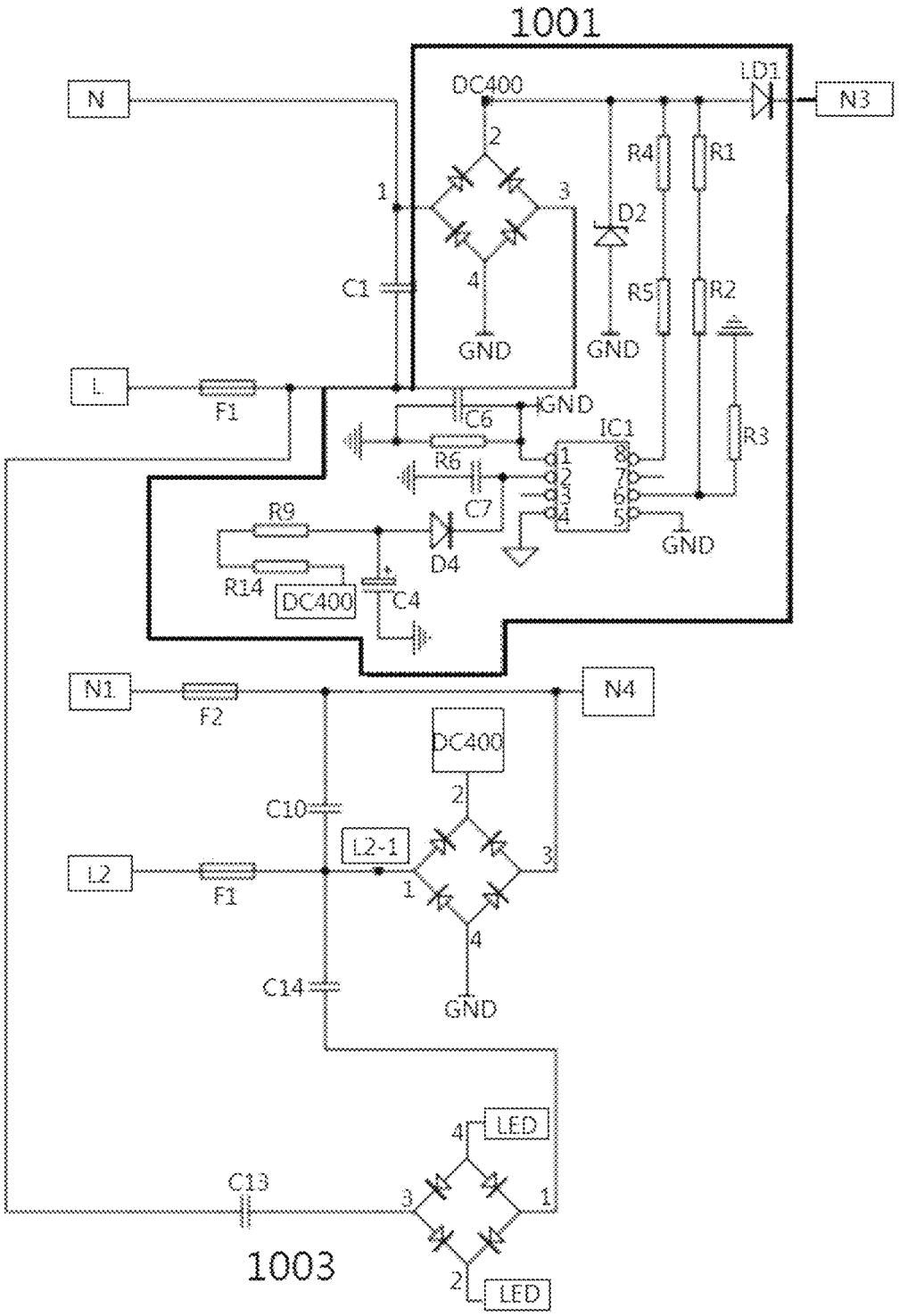
FIGS. 1A-1C are schematic diagrams of a control circuit of a lamp tube according to an embodiment of the invention.
Figure 1B:
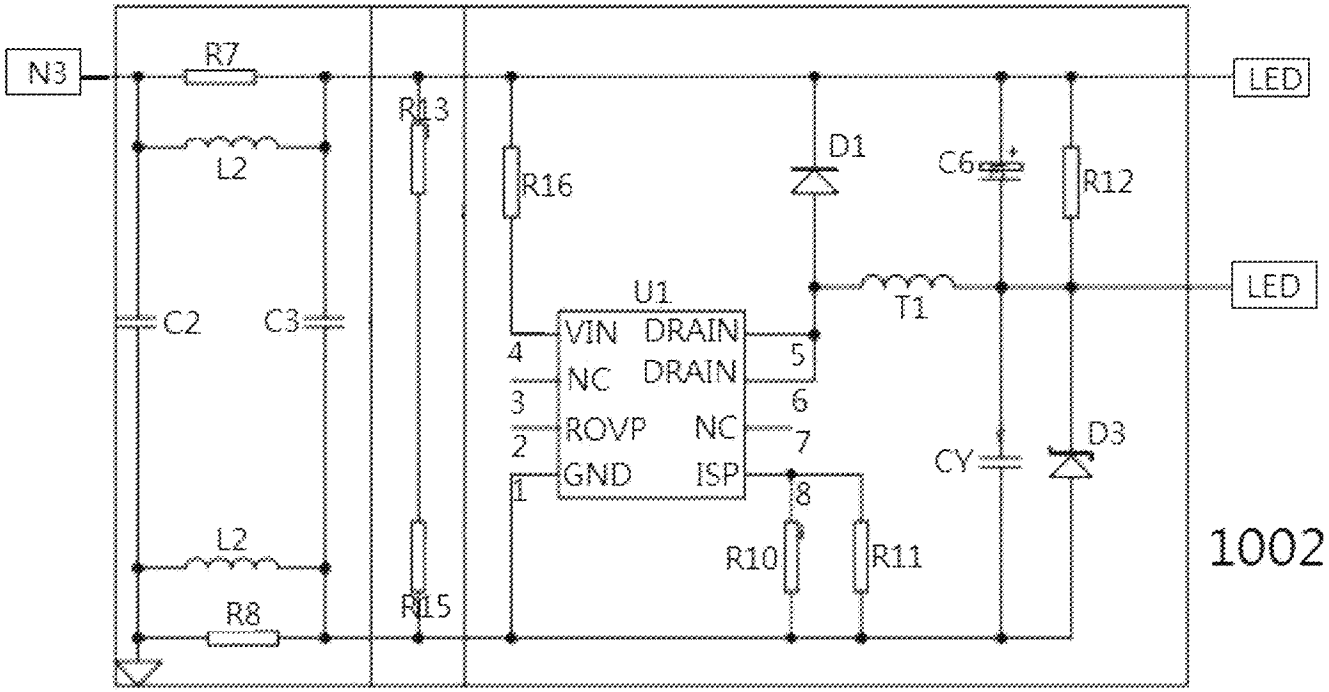
Figure 1C:
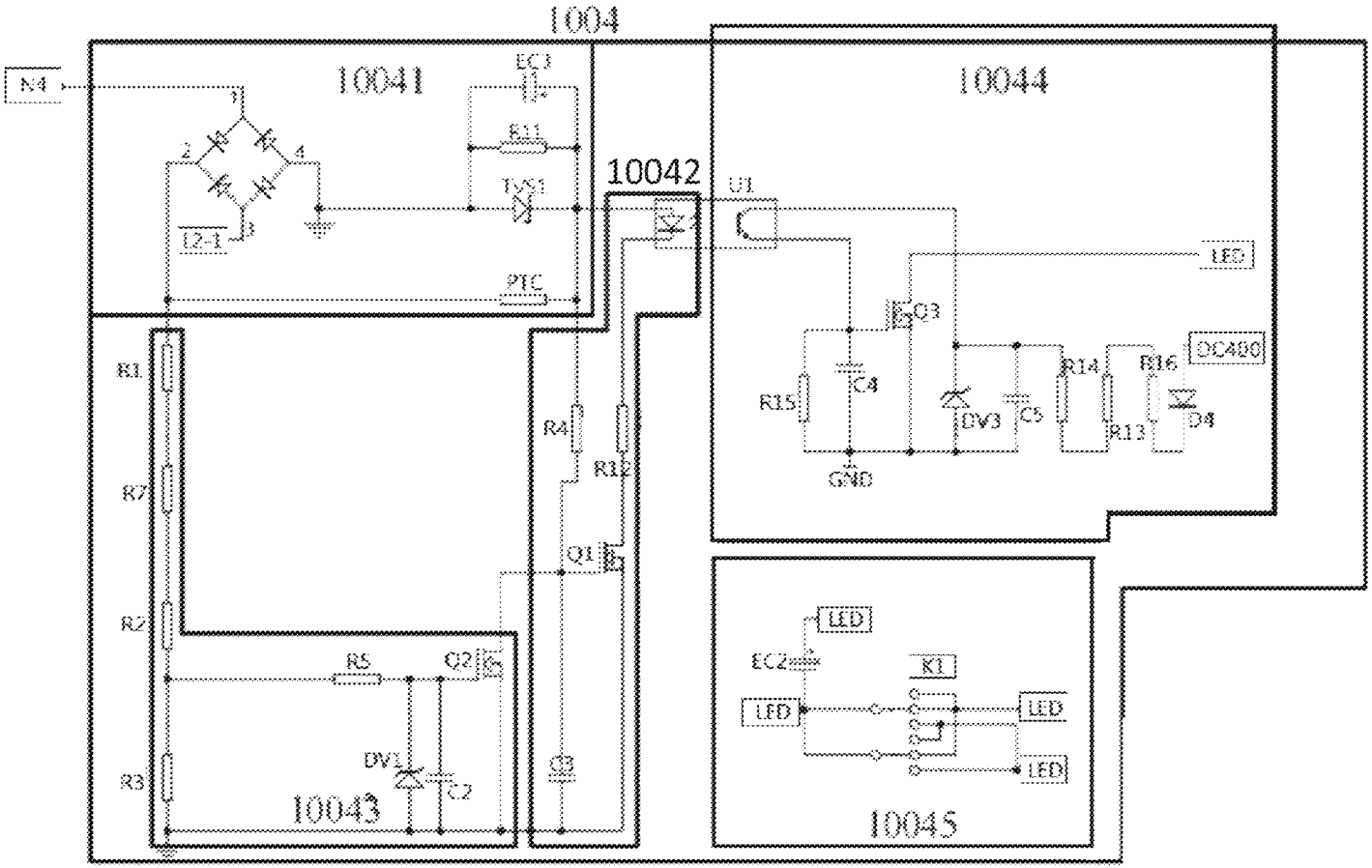
Figure 2:
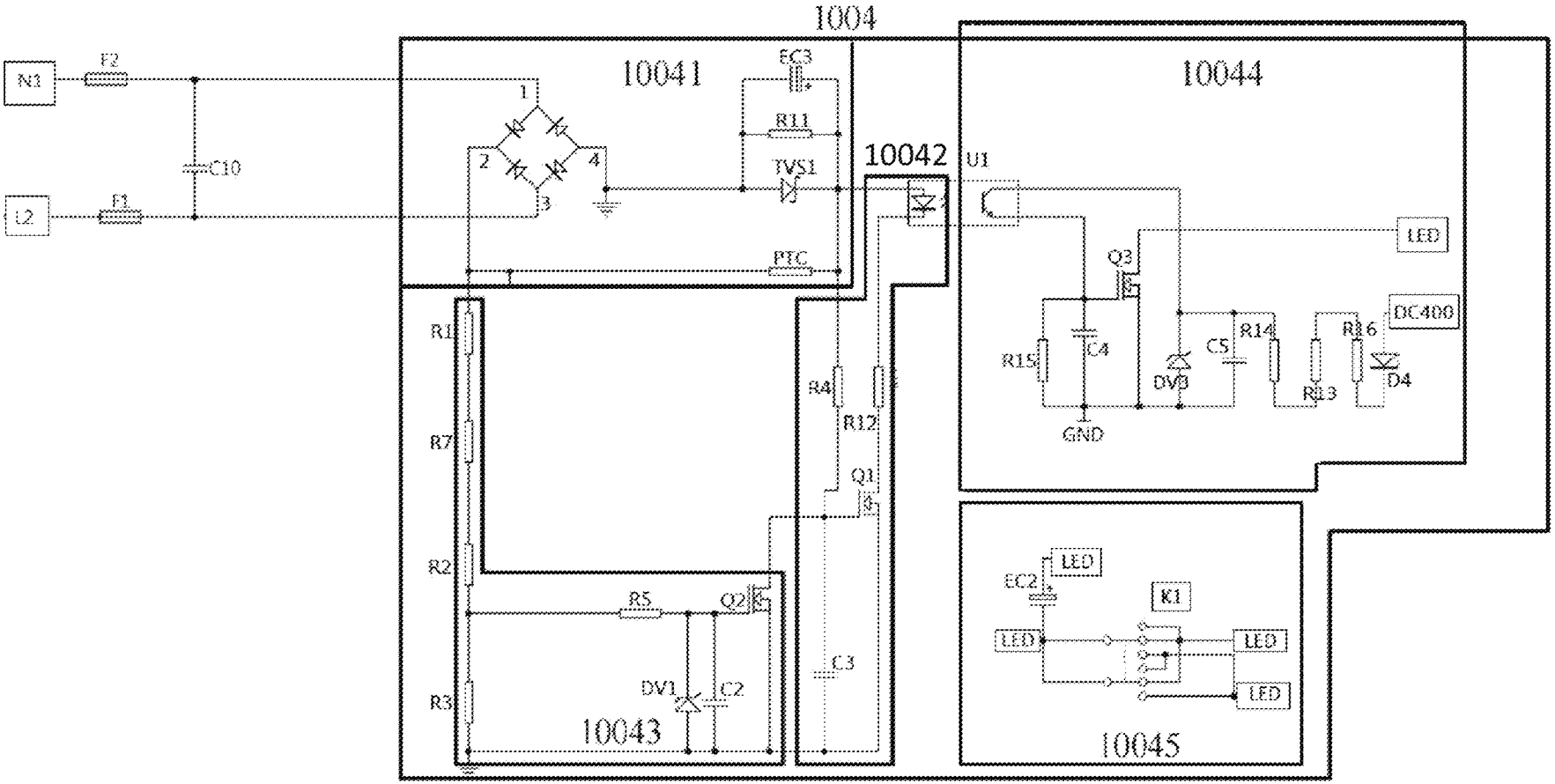
FIG. 2 is a schematic diagram of a fast-start type inductive rectifier detection and driving circuit of a lamp tube according to an embodiment of the present invention.

Please refer to FIGS. 1A-1C and FIG. 2. FIGS. 1A-1C are schematic diagrams of a control circuit of the lamp tube according to an embodiment of the present invention. FIG. 2 is a schematic diagram of a fast-start type inductive rectifier detection and driving circuit of a lamp tube according to an embodiment of the present invention.

A lamp tube with anti-shock protection and compatible with a plurality of current stable power supply modes is provided. Two conductive pin sets are configured at two ends of the lamp tube to be electrically connected to the power supply. In an embodiment, each conductive pin set includes two pins (such as pins N, L and pins N1, L2). The lamp tube includes a plurality of lighting loads (such as LED light-emitting components or other light-emitting components) and a control circuit. The control circuit is electrically connected to a plurality of lighting loads and two conductive pin sets, respectively.

The control circuit includes an electric shock protection circuit 1001, a filtering and constant current drive circuit 1002, a type A electronic rectifier circuit 1003, and a fast start inductive rectifier detection and drive circuit 1004 which are electrically connected to each other directly or indirectly. The electric shock protection circuit 1001 is connected to the two pins at ends of the lamp tube via rectifier bridges DB and DB1 to avoid the risk of electric shock when the lamp tube is installed. The filtering and constant current driving circuit 1002 is configured for filtering the DC starting voltage output from the type A electronic rectifier circuit 1003 and adjusting the current output to the light load via the constant current. The fast-start inductive rectifier detecting and driving circuit 1004 includes an input voltage rectification and voltage clamp module 10041, a fast-start inductive rectifier pre-driver module 10042, a fast-start inductive rectifier identification module 10043, a fast-start inductive rectifier output driver module 10044, and an output load selection module 10045 connected to each other.

In an embodiment, the input voltage rectifier and voltage clamp module 10041 includes a first resistor R11, a transient voltage suppressor diode TVS1, a positive temperature coefficient thermistor (PTC) resistor, and an electrolytic capacitor EC3. The PTC resistor is electrically connected in series with the transient voltage suppressor diode TVS1. A first resistor R11 (for example a resistance value of the resistor ranges from 10Ω to 100 KΩ) is connected in parallel with two ends of the transient voltage suppressor diode TVS1 as a dummy load. The electrolytic capacitor EC3 is connected with two terminals of the first resistor R11, and a transient voltage suppressor diode TVS1. Then, the input voltage rectifier and voltage clamp module 10041 rectifies the input AC voltage to a pulsating DC voltage, and clamps the rectified pulsating DC voltage via the first resistor R11, transient voltage suppressor diode TVS1, and the PTC resistor as the power supply for a signal transmission component U1 (such as a photoelectric coupler, a transformer, a solid state relay, or other isolated coupling devices).

The fast-start inductive rectifier pre-driver module 10042 includes a second resistor R4, a third resistor R12, a first capacitor C3, and a first MOS tube. After the voltage is clamped, the second resistor R4 limits the current. Then, the third capacitor C3 is charged. At the time, the voltage across the terminals of the third capacitor C3 is higher than the gate turn-on voltage of the first MOS tube Q1. The signal path is as follows: the pulsating DC voltage signal after the rectification of the first MOS tube Q1 is clamped via the first resistor R11, the transient voltage suppressor diode TVS1, and the positive temperature coefficient thermistor PTC, and then passes through the positive input terminal of the signal transmission component U1 (such as a photo coupler) ctive rectifier pre-drf the signaling component U1, the current limiting of the seventh resistor R12→the D pole of the first MOS tube Q1→the S pole of the first MOS tube Q1→ground. The signal (such as the pulsating DC voltage after rectification) is coupled to the output of the photocoupler while the signal (such as the pulsating DC voltage signal after the rectification) passes through the signal transfer assembly U1 (such as a photocoupler).

The fast-start inductive rectifier identification module 10043 includes a fourth resistor R1, a fifth resistor R2, a sixth resistor R3, a seventh resistor R5, an eighth resistor R7, a second capacitor C2, a signal clamp regulator DV1, and a second MOS tube Q2. A voltage divider circuit includes the fourth resistor R1, the fifth resistor R2, the sixth resistor R3, and the eighth resistor R7. A RC filter circuit includes the seventh resistor R5 and the second capacitor C2. The maximum voltage across two ends of the filament winding is set according to different fast-start inductive rectifier sets. In an embodiment, when the actual voltage exceeds the preset voltage, a non-fast-start inductive rectifier work mode is a default work mode. For example, the operation process: when the actual voltage of the voltage divider circuit is higher than that of the normal fast-start inductance rectifier operating mode, the voltage across the sixth resistor R3 becomes higher. Then, the voltage signal is current limited by the seventh resistor R5, and the second capacitor C2 is charged. When the voltage of the second capacitor C2 is higher than the gate conduction voltage of the second MOS tube Q2, the second MOS tube Q2 is conducted. The voltage signal through the first MOS tube Q1 is pulled down, and then the signal transfer assembly U1 does not output. The signal path is as follows: when the voltage across the sixth resistor R3 becomes high→the current limiting of the voltage signal via the seventh resistor R5→the second capacitor C2 is charged→when the voltage of the second capacitor C2 is higher than the gate conduction voltage of the second MOS tube Q2→the second MOS tube Q2 is conducted→the voltage signal through the first MOS tube Q1 is pulled down, and then the signal transfer assembly U1 (such as a photocoupler) does not output. The fast-start inductive rectifier pre-driver module 10042 is at least 1 ms slower than the fast-start inductive rectifier identification module 10043 at each power-up time.

The fast-start inductive rectifier output driver module 10044 includes a ninth resistor R13, a tenth resistor R14, a eleventh resistor R15, a twelfth resistor R16, a diode D4, a third capacitor C4, a fourth capacitor C5, a signal clamp regulator DV3, and a third MOS tube Q3. A drive signal source clamping and filter circuit includes the twelfth resistor R16, the ninth resistor R13, the tenth resistor R14, the diode D4, the fourth capacitor C5, and the signal clamp regulator DV3. The drive actuator circuit includes the output terminal of the signal transfer assembly U1 (such as a photocoupler), the third MOS tube Q3, the eleventh resistor R15 and the third capacitor C4. The drive actuator circuit is used to filter and smoothly drive the signal coupled to the output terminal of the fast-start inductive rectifier pre-driver module 10042 through the signal transmission component U1 (such as a photoelectric coupler) to drive the third MOS tube Q3. In the embodiment, the fast-start inductive rectifier output drive module 10044 is an electronic switch (the third MOS tube Q3), which is not limited herein. In other embodiments, the fast-start inductive rectifier output drive module 10044 is driven and controlled via a mechanical relay or a solid-state relay, and the number of switches is not limited herein.

The output load selection module 10045 includes a toggle switch K1 and a filter capacitor EC2. The toggle switch K1 is used to select the output load to change the color temperature or the output power function.

In the embodiment, under the condition that the fast-start inductive rectifier identification module 10043 is compatible, the rectifier bridge DB directly rectifies the AC signal from the fast-start inductive rectifier identification module 10043.

In the embodiment, after the fuse is connected to the pins at two terminals of the lamp tube, the fifth capacitor C1 and the sixth capacitor C10 with capacitance of 1.0 nF~100 nF are connected in front of the rectifier bridge DB and DB1, respectively.

In this embodiment, the lamp tube further includes a toggle switch K1 to select the output load, and then the color temperature or the output power function can be changed.

To make the lamp tube compatible with a fast-start inductive rectifier, besides the electric shock protection circuit 1001, the filtering and constant current drive circuit 1002 and the type A electronic rectifier circuit 1003, the control circuit 100 further includes the fast-start inductive rectifier detection and drive circuit 1004. Then, the electronic rectifier is compatible with fast-start inductive rectifier and mains-powered lamp tubes, and the leakage protection is also reliable. Additionally, the input to the lamp tube can be from either end of the lamp tube, and the light adjusting requirement in the rectifier mode can be meet.

Although the present invention has been described in considerable detail with reference to certain preferred embodiments thereof, the disclosure is not for limiting the scope of the invention. Persons having ordinary skill in the art may make various modifications and changes without departing from the scope. Therefore, the scope of the appended claims should not be limited to the description of the preferred embodiments described above.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A lamp tube with anti-shock protection and compatible with a plurality of current stable power supply modes, comprising: two conductive pin sets are configured at two ends of the lamp tube to be electrically connected to a power supply, respectively, the conductive pin set includes two pins, the lamp tube includes a plurality of lighting loads and a control circuit, the control circuit is electrically connected to the lighting loads and the two conductive pin sets, respectively, the control circuit includes an electric shock protection circuit, a filtering and constant current driving circuit, an electronic rectifier circuit and a fast-start inductive rectifier detection and driving circuit, the fast-start inductive rectifier detection and driving circuit further includes an input voltage rectification and voltage clamp module, a fast-start inductive rectifier pre-driver module, a fast-start inductive rectifier identification module, a fast-start type inductive rectifier output drive module, and an output load selection module, the input voltage rectifier and voltage clamp module includes a first resistor, a transient voltage suppressor diode, and a positive temperature coefficient thermistor, and an electrolytic capacitor, a positive temperature coefficient thermistor, the positive temperature coefficient thermistor is electrically connected in series with the transient voltage suppressor diode, the first resistor is connected in parallel with two ends of the transient voltage suppressor diode as a dummy load, the electrolytic capacitor is connected in parallel with two ends of the transient voltage suppressor diode and the first resistor to have DC filtering, the input voltage rectification and voltage clamp module rectifies an input AC voltage to convert the AC voltage to a pulsating DC voltage and clamps the rectified pulsating DC voltage via the first resistor, the transient voltage suppression diode, and the positive temperature coefficient thermistor as a power supply for a signal transfer assembly.

2. The lamp tube with anti-shock protection and compatible with a plurality of current stable power supply modes according to claim 1, wherein the signal transfer assembly is a photoelectric coupler, a transformer or a solid state relay.

3. The lamp tube with anti-shock protection and compatible with a plurality of current stable power supply modes according to claim 1, wherein a resistance value of the first resistor ranges from 10Ω to 100 KΩ.

4. The lamp tube with anti-shock protection and compatible with a plurality of current stable power supply modes according to claim 1, wherein the fast-start inductive rectifier pre-stage drive module includes a second resistor, a third resistor, a first capacitor, and a first MOS tube, the clamped voltage charges the first capacitor after the current is limited by the second resistor, when the voltage across terminals of the first capacitor is higher than a gate turn-on voltage of the first MOS tube, a pulsating DC voltage signal after the first MOS tube rectification is clamped via the first resistor, the transient voltage suppressor diode, and the positive temperature coefficient thermistor, and then transmitted from an positive input of the signal transfer assembly to an negative input of the signal transfer assembly, with current limiting of the third resistor, the signal passes from a drain terminal to a source terminal of the first MOS tube, and then transmitted to the ground, and when the signal passes through the signal transmission component, the signal is coupled to an input end of a photocoupler.

5. The lamp tube with anti-shock protection and compatible with a plurality of current stable power supply modes according to claim 1, wherein the fast-start inductive rectifier pre-stage drive module includes a fourth resistor, a fifth resistor, a sixth resistor, a seventh resistor, an eighth resistor, a second capacitor, a signal clamp regulator, and a second MOS tube, a voltage divider circuit includes the fourth resistor, the fifth resistor, the sixth resistor, and the seventh resistor, a RC filter circuit includes the seventh resistor and the second capacitor, a maximum voltage across two ends of the filament winding is set according to different fast-start inductive rectifier sets, when an actual voltage exceeds a preset voltage, a non-fast-start inductive rectifier work mode is a default work mode, an operation process is as follows: when the voltage of the voltage divider circuit is higher than the voltage of a normal fast-start inductance rectifier operating mode, the voltage across the sixth resistor becomes high, a voltage signal has a current limiting via the sixth resistor, the first capacitor is charged, when the first capacitor voltage is higher than a gate conduction voltage of the second MOS tube, the second MOS tube is conducted, the voltage signal through the first MOS tube is pulled down to make the signal transfer assembly not output.

6. The lamp tube with anti-shock protection and compatible with a plurality of current stable power supply modes according to claim 5, wherein the fast-start inductive rectifier pre-stage drive module is at least 1 ms slower than the fast-start inductive rectifier identification module at each power-on time.

7. The lamp tube with anti-shock protection and compatible with a plurality of current stable power supply modes according to claim 1, wherein the fast-start inductive rectifier output drive module includes a ninth resistor, a tenth resistor, an eleventh resistor, a twelfth resistor, a diode, a third capacitor, a fourth capacitor, a signal clamp regulator, and a third MOS tube, a drive signal source clamping and filter circuit includes the twelfth resistor, the ninth resistor, the tenth resistor, the diode, the fourth capacitor, and the signal clamp regulator, the drive actuator circuit includes an output terminal of the signal transfer assembly, the third MOS tube, the eleventh resistor, and the third capacitor, the drive actuator circuit is used to filter and smooth a signal of an output end of the signal transfer assembly to drive the third MOS tube.

8. The lamp tube with anti-shock protection and compatible with a plurality of current stable power supply modes according to claim 7, wherein the third MOS tube is replaced by a mechanical relay or a solid state relay.

9. The lamp tube with anti-shock protection and compatible with a plurality of current stable power supply modes according to claim 1, wherein the output load selection module includes a toggle switch and a filter capacitor.

10. The lamp tube with anti-shock protection and compatible with a plurality of current stable power supply modes according to claim 1, wherein the fast-start inductive rectifier pre-stage drive module is at least 1 ms slower than the fast-start inductive rectifier identification module at each power-on time.

11. The lamp tube with anti-shock protection and compatible with a plurality of current stable power supply modes according to claim 1, wherein the anti-touch protection circuit is connected to the two pins at two ends of the lamp tube via two rectifier bridges, after the fuse is connected to the pins at two ends of the lamp tube, a fifth capacitor and a sixth capacitor with capacitance of 1.0 nF~100 nF are connected in front of the rectifier bridges, respectively.

* * * * *